United States Patent [19]

Hermann

[11] 3,935,601

[45] Feb. 3, 1976

[54] SANITARY TOILET SEAT RING LIFT

[76] Inventor: Milton A. S. Hermann, 1355 N. Sandburg Terrace, Apt. 9020, Chicago, Ill. 60610

[22] Filed: Dec. 23, 1974

[21] Appl. No.: 535,275

[52] U.S. Cl. ..... 4/251; 4/237 X

[51] Int. Cl.² ..... A47K 13/10

[58] Field of Search ..... 4/251, 237, 234, 235, 236, 4/238, 239, 240, 241, 1

[56] References Cited

UNITED STATES PATENTS

| | | | |
|---|---|---|---|
| 636,564 | 11/1899 | Russell | 4/237 X |
| 1,999,555 | 4/1935 | Adams | 4/251 |
| 2,236,576 | 4/1941 | Loebner | 4/251 |
| 2,758,315 | 8/1956 | Hylton | 4/251 |
| 3,191,193 | 6/1965 | Bogenberger | 4/251 |
| 3,566,421 | 3/1971 | Waddle | 4/237 |
| 3,717,884 | 2/1973 | Mantooth | 4/237 |
| 3,783,455 | 1/1974 | Vanderbrook | 4/1 |

*Primary Examiner*—Henry K. Artis

*Attorney, Agent, or Firm*—Wegner, Stellman, McCord, Wiles & Wood

[57] ABSTRACT

A sanitary lift for a toilet seat ring pivoted to a toilet bowl with the under surface of the toilet seat ring being spaced above the top of the bowl includes a base member secured to the under surface of the toilet seat ring with an outer edge adjacent to the outer edge of the ring. A shield member which depends from the outer edge of the base member spans the gap between the under surface of the ring and the top of the bowl. A lift member extends outwardly from the shield member with a manually engageable under surface for lifting the toilet seat ring without the user's fingers or the lift member touching the toilet bowl or being soiled by its contents.

20 Claims, 6 Drawing Figures

SANITARY TOILET SEAT RING LIFT

BACKGROUND OF THE INVENTION

This invention relates to a sanitary toilet seat ring lift which permits the user to lift the toilet seat ring without touching the bowl or its spattered contents.

In addition to statutes requiring sanitary toilet seat ring lifts in public restrooms, the desirability of a lift which permits a person to raise a toilet seat ring without soiling his hand has long been recognized. Representative prior art includes U.S. Pat. No. 1,999,555 to Adams.

Typically, lifts have a gripping portion which extends laterally from a member attached to the underside of a toilet seat. Most of these lifts have one fault in common, the susceptibility of their gripping portions to be soiled by the spattered contents of the toilet bowl. This common fault defeats their intended purpose as a sanitary precaution.

Adams U.S. Pat. No. 1,999,555 attempted to overcome this fault by adding a depending flange in forming part of the gripping portion. However, the flange only protects a certain segment of the gripping portion as its bottom edge curves upwardly toward the underside of the gripping portion near the ear portion which is attached to the underside of the toilet seat. This curvature permits the spatter to pass through the space between the seat and the bowl onto the upwardly curved bottom edge of the flange. The bottom edge can spray the spatter onto the gripping portion.

Moreover, the handle extends laterally and is offset upwardly from the ear portion to leave a gap between the handle and the peripheral edge of the seat. The combination of the longitudinally extending handle and gap presents a hazard to the user and his clothing. Inadvertently, the user could easily impale his leg on the protruding handle lip when standing up or moving to the side of the toilet. A further inadvertency by the user could result in snagging his clothing on the handle.

SUMMARY OF THE INVENTION

The present invention provides a toilet seat ring lift which avoids unsanitary conditions or possible injury to the user.

It is a primary object of the present invention to provide a sanitary toilet seat lift which protects the gripping portion from being spattered by the contents of the toilet bowl.

It is another object of the present invention to provide a sanitary toilet seat lift that prevents the fingers of the user from touching the toilet bowl when gripping it.

A further object of the present invention is to provide a sanitary toilet seat lift which can be attached to the toilet ring with or without mechanical fasteners.

A still further object of the present invention is to provide a sanitary toilet seat lift without obstructing fingers, sharp edges, ridges and corners which result in snagged clothing and difficult surfaces to clean.

Another object of the present invention is to provide a sanitary toilet seat lift that, when attached to the flat underside of the toilet seat, has members which are all below the toilet seat and close to the toilet bowl for avoiding injury to the user where derriere and lower extremities might otherwise come into contact or even break off a member of the toilet seat lift.

Yet another object of the present invention is to provide a toilet seat lift of the above mentioned type which can be incorporated into the molding of a toilet seat ring.

In accordance with the present invention, a sanitary toilet seat ring lift which eliminates a soiled gripping portion and an obstruction to cleaning, clothing and the user includes a generally rectangular base member of flat sheet material with a curved side. The curved side approximately matches the outer curvature of the flat underside of a toilet seat ring. A plastic adhesive tape or screws are used separately or together for securing the member to the underside of the toilet seat ring. A trapezoidal shield member of flat sheet material bows outwardly from the toilet bowl and it depends from the curved side a sufficient distance and at substantially a right angle to the base so that it spans the gap between the toilet seat ring and bowl. A lift member of flat sheet material projects laterally from a point intermediate the parallel sides and surface of the shield member which faces away from the toilet bowl. The three members form an integral toilet seat lift with at least a digit between the lift member and bottom edge of the shield member to shield the lift member from being spattered by the contents of the toilet bowl and to prevent the user's fingers from contacting the toilet bowl.

According to another embodiment of the invention, the aforementioned sanitary toilet seat lift is incorporated into the toilet seat ring where the shield and lift members are substantially the same size and shape as the previously described toilet ring lift and the toilet seat ring itself serves as the base member.

Preferably, a sanitary toilet seat ring lift made according to the invention is molded out of a suitable plastic material which may vary in flexibility or is molded out of the toilet seat ring material if molded integral therewith.

Other objects and advantages of the invention will become apparent in the following specification taken in connection with the accompanying drawing.

DESCRIPTION OF THE PREFERRED EMBODIMENT

Figure 4:
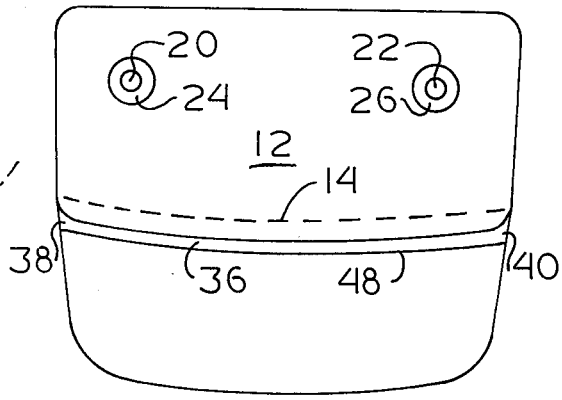
FIG. 4 is a bottom view of the lift of FIG. 1.
Figure 5:
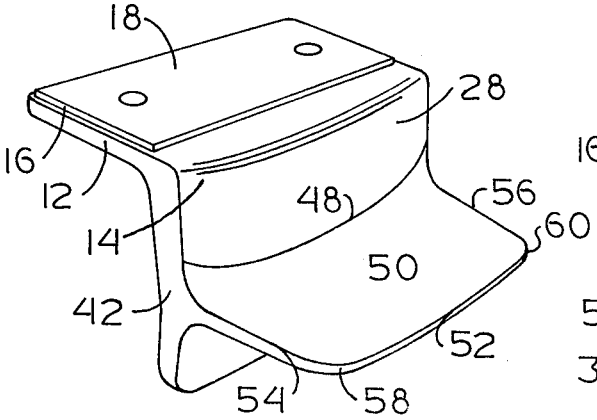
FIG. 5 is a perspective view thereof.
Figure 6:
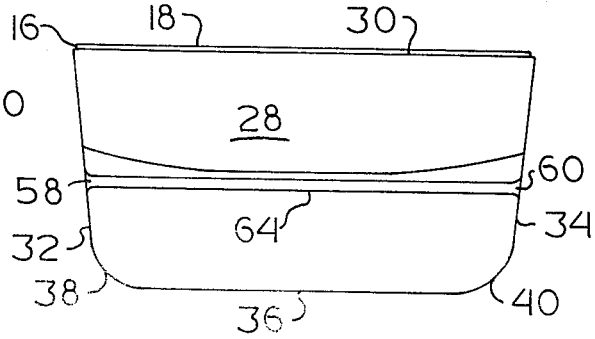
FIG. 6 is an elevation thereof.

One embodiment of the toilet seat ring lift with an improved sanitary shield made according to the invention is illustrated in FIGS. 1–2 and 4–6, and includes a one-piece molded part 10 of several elements. The elements of the lift 10 include a generally rectangular base member 12 of 3 inches in length, 1-1/16 inches in width and a curved side 14 on one of the 3 inch sides with a 10 inch radius of curvature. The base member 12 consists of a plastic flat sheet material approximately 7/64 inch thick. The base member 12 has a 1 × 3 inch strip 16 of plastic adhesive tape with a protective covering 18 bonded to the surface as seen in FIG. 5. The base member 12 also has a pair of screw holes 20 and 22 which are spaced 2 inches apart and ½ inch from the corners. The holes 20 and 22 are provided with beveled lips 24 and 26, respectively, for receiving a flat screw head with a taper as shown in FIG. 4.

A bowed trapezoidal shield member 28 of a flat sheet material similar to the base member 12 depends closely adjacent to a toilet bowl from a rounded edge connection with the curved side 14 of the base member 12. The curved parallel upper side 30 of the trapezoidal shield member 28 corresponds in length and curvature with the curved side 14 of the base member 12. The nonparallel sides 32 and 34 of the trapezoidal shield member 28 extend downwardly 1½ inches in length and inwardly at a 5° taper to the other parallel side 36 of 2-11/16 inches in length. The bottom edge 36 of the trapezoidal shield member 28 has round corners 38 and 40 to avoid any obstruction to cleaning or clothing. An apex 42 on the bowed portion of the trapezoidal shield member 28 faces outwardly from a toilet bowl 44 when the base member 12 is attached to the flat underside of a toilet seat ring 46 pivoted on the bowl 44 and has a curvature 48 with a radius of 10-3/16 inches relative to the curved side 14 of the base member 12.

A finger-gripping lift member 50 of identical material as the shield member 28 projects laterally from the apex 42 approximately 1¼ inches to a curved edge 52 which has a radius of 11-7/16 inches relative to the curved side 14 of the base member 12 and a longitudinal extension of 2-11/16 inches. The lift member 50 has sides 54 and 56 which taper inwardly toward the curved edge 52. The lift member 50 has a thickness which tapers from the apex 42 to the curved edge 52. The corners 58 and 60 of the lift member 50 are likewise round for protection against injury to a user 62 and damage to his clothing. A space of 5/8 inch extends from the underside 64 of the lift member 50 to the bottom edge 36 of the shield member 28.

Preferably, the members 12, 28 and 50 form a one-piece molded toilet seat ring lift 10 which is made out of a plastic material. The toilet seat ring lift 10 can be made of a material which varies in flexibility and in color according to its application.

Figure 3:
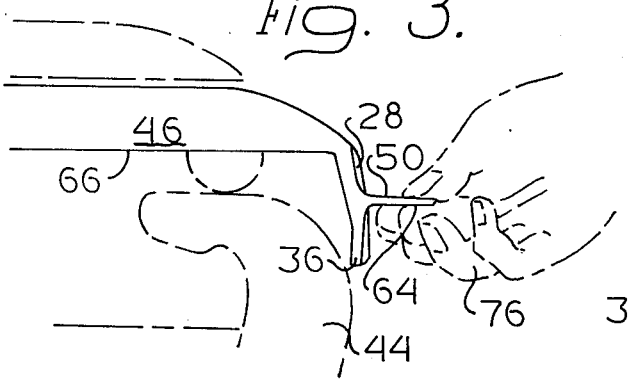
FIG. 3 is an end view of another embodiment thereof.

FIg. 3 is another embodiment of the invention. Here, the toilet seat ring 46 is substituted for the base member 12 but the shield and lift members 28 and 50, respectively, remain unchanged in size and shape from the first embodiment. This permits the toilet seat ring lift 10 of the present invention to be incorporated in the manufacturing process of the toilet seat ring 46.

Figure 1:
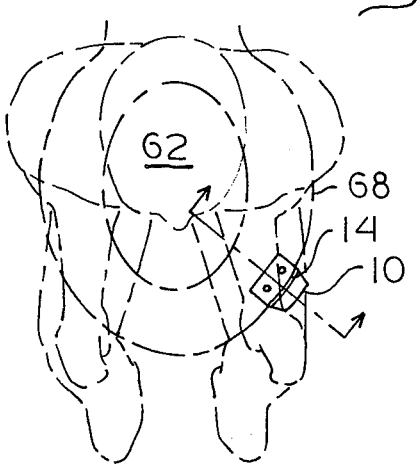
FIG. 1 is a plan view of a toilet seat ring lift embodying the invention, illustrating the attachment location on a toilet seat ring.
Figure 2:
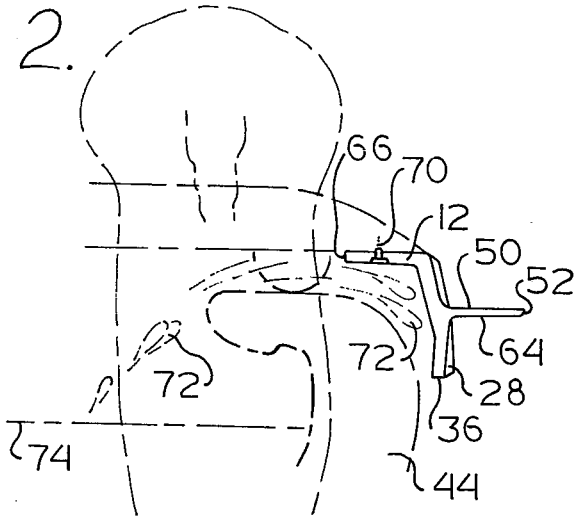
FIG. 2 is an end view thereof, taken along line 1—1 of FIG. 1, illustrating spatter from the toilet bowl.

Turning now to FIGS. 1, 2 and 5, the protective covering 18 is removed from the tape 16 on the base member 12 exposing the adhesive surface. The adhesive surface of the tape 16 is attached to the flat underside 66 of the toilet seat ring 46 so that the radius of the curved base member 14 corresponds to the radius of the curved outer edge 68 on the toilet seat ring 46. In addition to the adhesive tape 16, a further mechanical fastening is often desirable for use in a public restroom to make difficult the removal of the toilet seat ring lift 10. A screw connection, as depicted in FIG. 2, is used. Preferably, a flat head screw 70 with a taper corresponding to the beveled lips 24 and 26 of the screw holes 20 and 22, respectively, is used as the fastener to maintain a flush surface on the flat underside of the rectangular base member 12.

In summary, the toilet seat ring lift 10 provides a sanitary and safe means for lifting a toilet seat ring. The design of the lift 10 eliminates any contact with the derriere or lower extremities of the user 62 as well as any possible injury thereto because the lift 10 is attached to the underside of the toilet seat ring 46 with its curved side 14 flush with the outer peripheral edge 68 of the toilet seat ring so that the depending shield member 28 is closely adjacent the outside of the toilet bowl 44. The only protruding member of the toilet seat ring lift 10 is its lift member 50 which projects laterally a short distance from the depending trapezoidal shield member 28 at a safe distance below the top surface of the toilet seat ring 46. The shield member 28 of the lift 10 also spans the gap between the toilet ring 46 and bowl 44 to provide a shield for the lift member 50 so that it is impossible for any spatter 72 from the water 74 in the bowl 44 to soil the lift member 50 which is located above the bottom edge of the shield member 28. The shield member 28 also prevents the fingers 76 of the user from accidentally contacting the bowl 54 when operating the lift 10 since the gripping portion of the lift member 50 projects laterally at a point intermediate the parallel sides of the trapezoidal shield member 28 which leaves a space of at least a digit between the underside 64 of the lift member 50 and the bottom edge 36 of the shield member 28.

Moreover, the round corners and the smooth surfaces of the lift 10 as well as the round edge connections between each element provide an obstruction-free toilet seat ring for clothing, cleanliness and safety.

I claim:

1. A lift for a toilet seat ring pivoted to a toilet bowl and having an under surface spaced above the top of the bowl, comprising:

a base to be secured to the under surface of the toilet ring with an outer edge adjacent the outer edge of the ring;

a shield depending from the outer edge of the base to span the gap between the under surface of the ring and the top of the bowl; and a handle extending outwardly from the shield with a manually engageable under surface for lifting the toilet seat.

2. The toilet seat ring lift of claim 1 in which the under surface of the handle is above the lower edge of the shield.

3. The toilet seat ring lift of claim 1 in which the handle has an upper surface spaced below the upper surface of the toilet seat ring.

4. A toilet seat ring lift comprising:

a generally rectangular base member of flat sheet material with two round corners and a curved side;

means for securing said rectangular member to the underside of a toilet ring on a toilet bowl with said curved side approximately flush with the outer edge of said ring;

a bowed shield member of flat sheet material attached to and depending from the curved side at substantially a right angle to said rectangular member to span the gap between the toilet ring and bowl and terminating in a bottom edge with round corners; and a lift member of flat sheet material attached to and projecting laterally from an intermediate point on the surface of said bowed member facing away from said toilet bowl, said members forming an integral toilet seat ring lift with at least a digit between the lift member and the bottom edge of the bowed member to prevent contact with the toilet bowl and its contents when lifting the toilet seat ring.

5. The toilet seat ring lift of claim 4 in which said securing means is a pressure sensitive adhesive material on the surface of said base member engaging the underside of said toilet ring.

6. The toilet seat ring lift of claim 4 in which said securing means includes screws or the like extending through a pair of holes in said base member.

7. The toilet seat ring lift of claim 4 in which said bowed member extends downwardly and has a trapezoidal shape with the larger parallel side having a curvature and length equal to the curved side of said base member and attached thereto forming an integral round edge.

8. The toilet seat ring lift of claim 4 in which said integral lift is a one-piece molded part.

9. The toilet seat ring lift of claim 8 in which said molded lift is made out of a flexible material as plastic or the like in sundry colors.

10. The toilet seat ring lift of claim 8 in which said molded lift is made out of a rigid plastic material or the like in sundry colors.

11. A toilet seat ring lift for maintaining sanitary condition in the use of a toilet having a toilet bowl, a toilet seat ring pivoted to the toilet bowl with a flat underside resting on top of said bowl, comprising in combination:

a generally rectangular base member of flat sheet material with two round corners opposite a curved longitudinal side of said member having a uniform thickness with a smooth top and bottom surface, said member having spaced apart holes to receive fasteners for securing said member flush with the flat underside of said toilet seat ring by means of the fasteners extending through said holes;

a bowed trapezoidal shield member of flat sheet material with the larger parallel side attached to and matching the length and curve of said curved longitudinal side, said shield member extending downwardly at substantially a right angle to said fastened base member and of at least a length sufficient to span the gap between the toilet seat ring and the bowl and terminating in the smaller parallel side with round corners; and a finger-gripping member of flat sheet material projecting laterally from the curved flat surface of the shield member facing away from the toilet bowl at a point intermediate the parallel sides and terminating in an edge with round corners, whereby said round corners prevent an obstruction to cleaning or clothing and said gripping member is positioned on said shield member so that the distance between the smaller parallel side and the gripping member is at least a digit to prevent the fingers of a user from contacting the bowl or its splashed contents when operating the toilet ring lift.

12. The toilet seat ring lift of claim 11 wherein said base, shield and gripping members form a one-piece molded part.

13. The toilet seat ring lift of claim 11 wherein the holes have a beveled lip and said fasteners are screws with a flat head and taper which become flush with the bottom surface of said base member when tightly screwed into the toilet ring.

14. The toilet seat ring lift of claim 11 wherein an adhesive tape is bonded to the top surface of the base member for fastening same to the flat underside of said toilet ring.

15. The toilet seat ring lift of claim 11 wherein said one-piece molded part is 3 inches long, 2½ inches wide and 1½ inches high with the finger-gripping member ⅝ inch above the smaller parallel side of said trapezoidal member, said rectangular member is 1-1/16 inches wide, 3 inches long and 7/64 inch thick with said curved longitudinal side having a radius of 10 inches, said trapezoidal member is 3 inches long on said larger parallel side, 2-11/16 inches long on said smaller parallel side and approximately 1½ inches in length on the nonparallel sides with a taper of 5° inwardly toward the smaller parallel side, and said gripping member projects laterally 1¼ inches from the outwardlymost bowed part of said trapezoidal member before terminating in an outer edge of 2-11/16 inches in length with a curvature of an 11-7/16 inch radius with respect to said curved side.

16. A lift for the seat ring of a toilet bowl, said ring having a flat underside facing the top of said bowl, comprising:

a depending member of flat sheet material integral with said flat underside, and bowed outwardly from said bowl and spanning the gap between the ring and the bowl, having an upper edge approximately flush with the outer edge of the seat ring and a bottom edge with round corners; and a gripping member of flat sheet material projecting laterally from the side of said depending member facing away from said bowl intermediate said upper and bottom edges so that the space between the gripping member and the bottom edge of said depending member is at least a digit to avoid finger contact with the bowl or its contents when using the toilet ring lift.

17. The toilet seat ring lift of claim 16 in which said ring, downwardly extending and gripping members are molded in an integral piece.

18. The toilet seat ring lift of claim 16 in which said gripping member tapers slightly as it projects laterally from said downwardly extending member.

19. A sanitary toilet seat ring lift, comprising:

an attachment member with a curved side;

means for securing said attachment member to the underside of a toilet ring on a bowl in which the radius of said curved side matches the underside radius of the curvature in the toilet ring;

a shield member extending downwardly from a connection with said curved side to span the gap between the toilet ring and bowl before terminating in a bottom edge; and a lift member projecting laterally from a point intermediate said curved side and bottom edge so that a space equal to at least a digit exists between the lift member and the bottom edge of the shield member to prevent finger contact with the bowl or soiling of the lift member.

20. The toilet seat ring lift of claim 14 in which said attachment, shield and lift members form a one-piece molded part with round corners and edges for safety and cleanliness.

* * * * *